US005228275A

United States Patent [19]

Formo

[11] Patent Number: 5,228,275

[45] Date of Patent: Jul. 20, 1993

[54] PROCESS AND APPARATUS FOR PACKAGING LIMP ARTICLES

[75] Inventor: Alvin C. Formo, Seattle, Wash.

[73] Assignee: Formost Packaging Machines, Inc., Woodinville, Wash.

[21] Appl. No.: 891,370

[22] Filed: May 29, 1992

[51] Int. Cl.[5] ..... B65B 43/28; B65B 35/44

[52] U.S. Cl. ..... 53/572; 53/255; 53/391

[58] Field of Search ..... 53/459, 469, 473, 256, 53/255, 248, 259, 572, 391, 390, 468

[56] References Cited

U.S. PATENT DOCUMENTS 2,656,082 10/1953 Brown ..... 53/255 X 3,217,464 11/1965 Feingold ..... 53/259 X 3,412,522 11/1968 Schorer ..... 53/572

3,527,337 9/1970 Formo ..... 198/170

4,805,381 2/1989 Hannon ..... 53/572 X

*Primary Examiner*—James F. Coan

*Attorney, Agent, or Firm*—Robert W. Beach

[57] ABSTRACT

Stacks of limp articles such as flour tortillas are deposited on a conveyor having slotted blocks to support the stack in arched configuration with the central portion raised and side portions drooping from the central portion. A pusher having depending fingers with bent supporting ends is movable to push the stack of articles off the conveyor onto a guide into a bag and to move the filled bag onto a receiving trough.

9 Claims, 6 Drawing Sheets

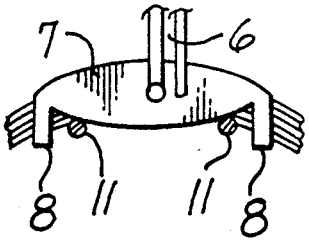
Fig. 8
Fig. 9
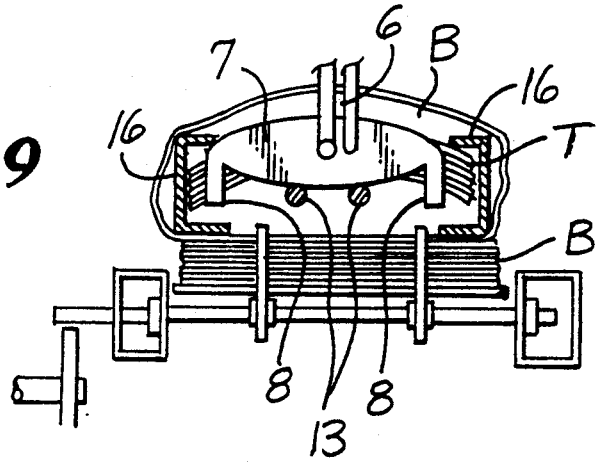
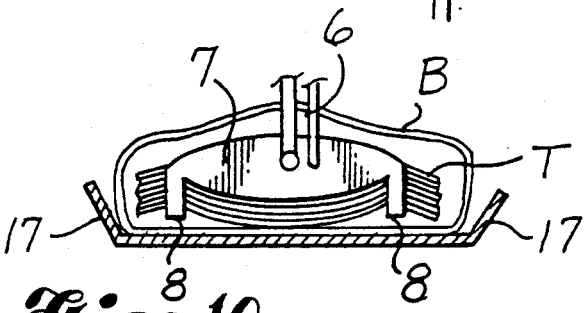
Fig. 10
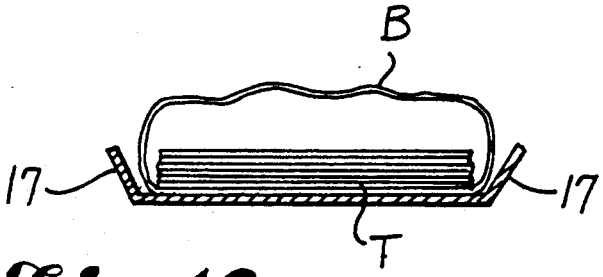
Fig. 12

PROCESS AND APPARATUS FOR PACKAGING LIMP ARTICLES

BACKGROUND OF THE INVENTION

1. Field of the Invention

This invention relates to a process and apparatus for packaging limp articles such as flour tortillas in stacks.

2. Prior Art

The general type of packaging machine to which the present invention relates is shown in Formo U.S. Pat. No. 3,527,337, issued Sep. 8, 1970. This patent shows a bagging machines for bagging various types of articles, such as sliced loaves of bread, a cluster of bread rolls or other articles that can be moved as a group into a bag.

While the principle of circulating pushers used in the present invention is similar to the arrangement of circulating pushers shown in U.S. Pat. No. 3,527,337, the apparatus shown in that patent is incapable of packaging flat limp articles such as a stack of flour tortillas.

SUMMARY OF THE INVENTION

It is a principal object of the present invention to provide a process and apparatus for handling stacks of limp articles in a packaging operation.

A more specific object is to be able to support the stack of flat limp articles satisfactorily and reliably while they are being moved toward and into a receiving bag.

A further object is to provide such a bagging process and apparatus that can be operated at high speed despite the delicate character of the articles being handled.

It is also an object to minimize the hand labor and operator attention required in the performance of the process and operation of the apparatus.

The foregoing objects can be accomplished by a process utilizing apparatus including a loading conveyor for receiving stacks of flat limp articles in arched configuration for enabling a pusher engageable with the trailing edge of the stack to insert beneath the trailing margin of the stack underlapping support means depending from the pusher to enable the pusher to push a stack of such articles along a slide composed of two spaced rods and to push the stack from such slide into a receiving bag while supporting the trailing margin of the stack to maintain reliable engagement of the pusher with the trailing edge portion of the stack.

BRIEF DESCRIPTION OF THE DRAWINGS

FIGS. 8, 9 and 10 are transverse vertical sections through portions of the apparatus taken along lines 8—8, 9—9 and 10—10, respectively, of FIG. 1.

FIG. 12 is a vertical transverse section through a portion of the apparatus taken on line 12—12 of FIG. 1.

DETAILED DESCRIPTION

Figures 1, 3:
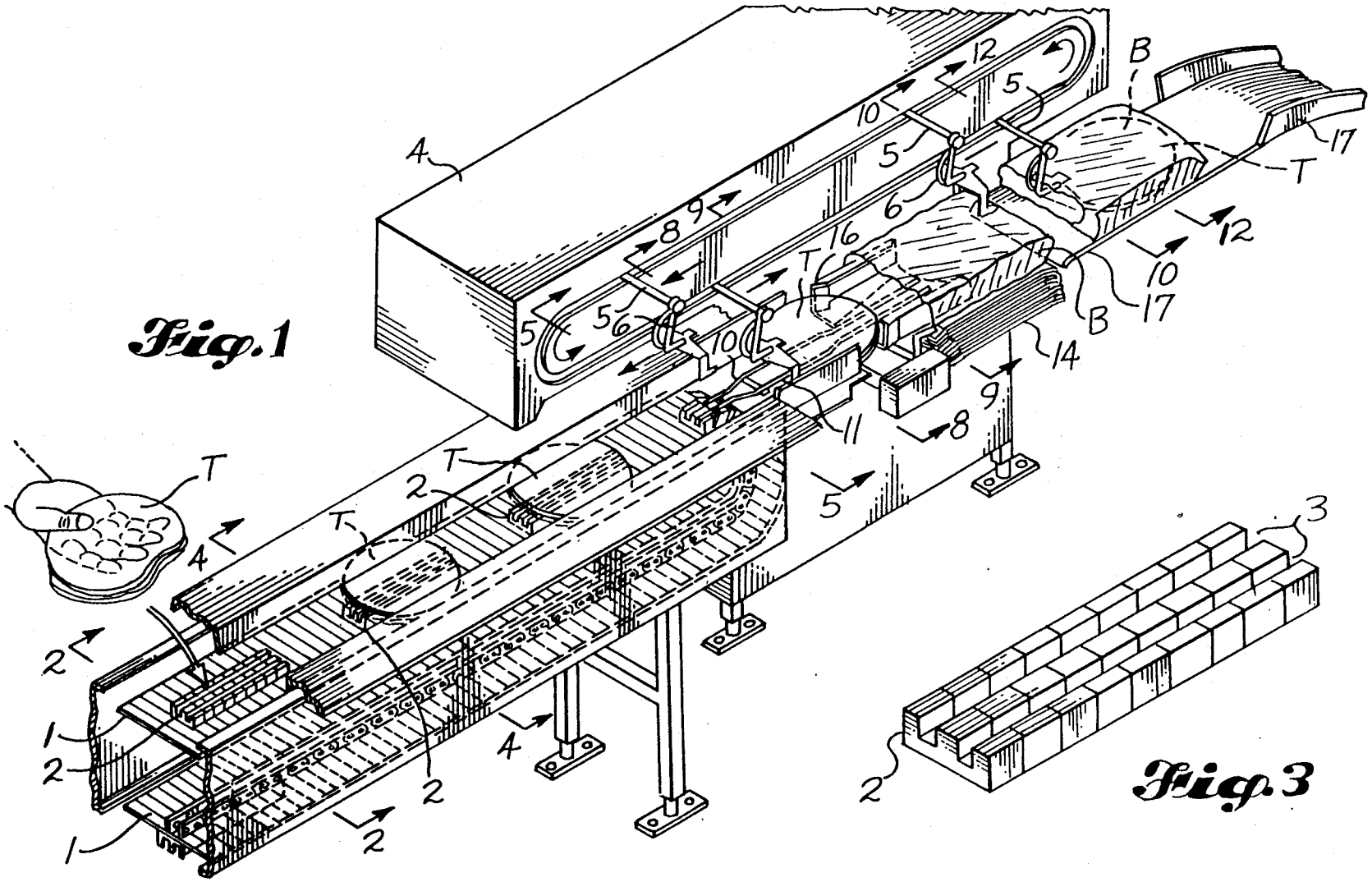
FIG. 1 is a top perspective of apparatus for performing the process of the present invention, parts being broken away.
FIG. 3 is a detail top perspective of a portion of the apparatus shown in FIGS. 1 and 2.
Figure 2:
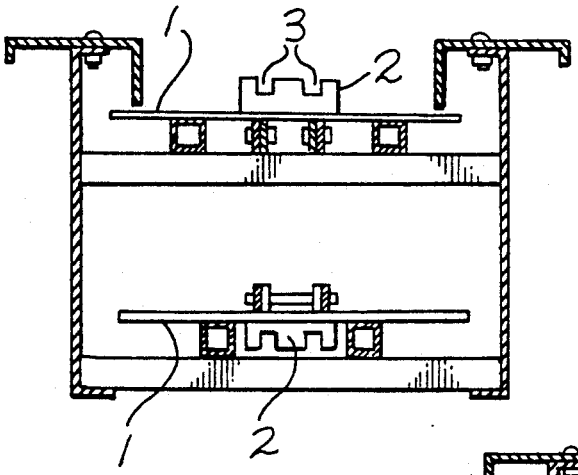
FIG. 2 is an enlarged transverse vertical section taken along line 2—2 of FIG. 1.

FIG. 1 shows the overall bagging apparatus, a portion of which will be seen to resemble the apparatus shown in FIG. 1 of U.S. Pat. No. 3,527,337. The apparatus shown in that patent does not have the slat type of loading conveyor 1 shown in FIG. 1. On each slat of that conveyor is mounted a grooved block 2 shown in detail in FIG. 3. Each block is multigrooved, that is, it has more than one groove in it, two grooves 3 being shown as the preferred type of block. The lengths of the grooves extend parallel to the direction of travel of the upper stretch of the slat conveyor which, as seen in FIG. 1, is from left to right.

Figure 4:
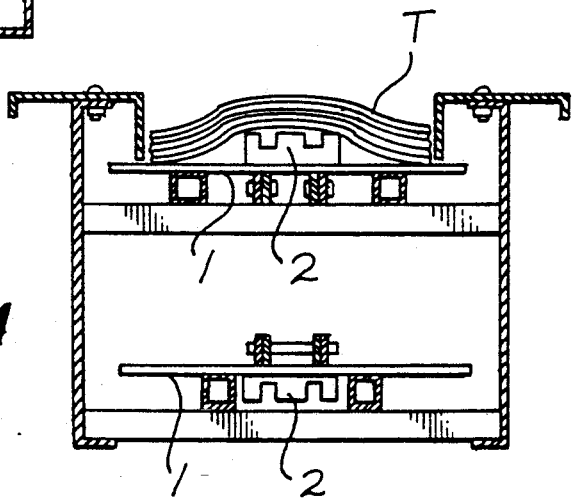
FIGS. 4 and 5 are transverse vertical sections taken through the apparatus of FIG. 1 on lines 4—4 and 5—5, respectively, of that figure.

The blocks 2 cooperatively form an articulated support over which a stack of limp articles, such as flour tortillas, can be draped, as shown in FIG. 4, by being placed manually on the conveyor as indicated in FIG. 1. While the row of blocks 2 could be continuous throughout the length of the conveyor 1, it is preferred that such blocks be arranged in groups with spaces between them as shown in FIG. 1. Each group will be of a length approximately equal to the diameter of a circular tortilla, and the groups of blocks will be spaced apart a distance corresponding to the spacing of the pushers of the pusher mechanism 4, although the groups of blocks 2 will be located somewhat closer together than the pushers because the pushers move faster than the slat conveyor 1.

The pusher mechanism 4 includes carrier rods 5 traveling around an orbit indicated by the arrows in FIG. 1, from which carrier rods depend arms 6 on which pushers 7 are mounted generally as disclosed in U.S. Pat. No. 3,527,337. The orbit of the pushers 7 overlaps to some extent the orbit of the loading conveyor 1, as shown in FIG. 1.

Figure 5:
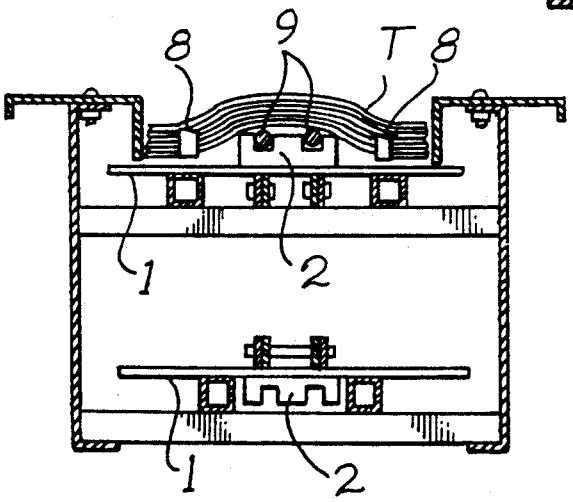
Figure 6:
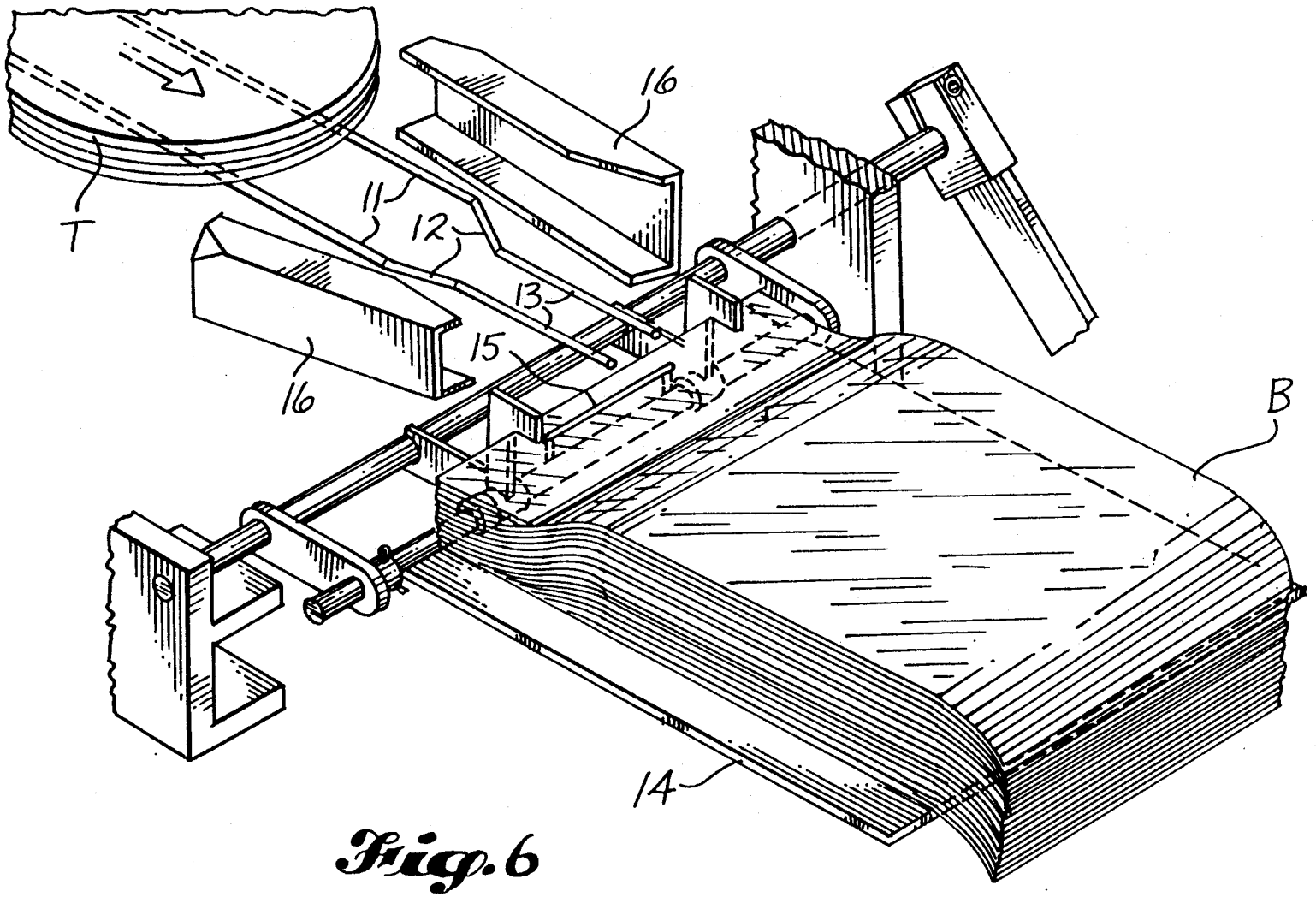
FIGS. 6 and 7 are top perspectives of a portion of the apparatus showing parts in different positions.
Figure 7:
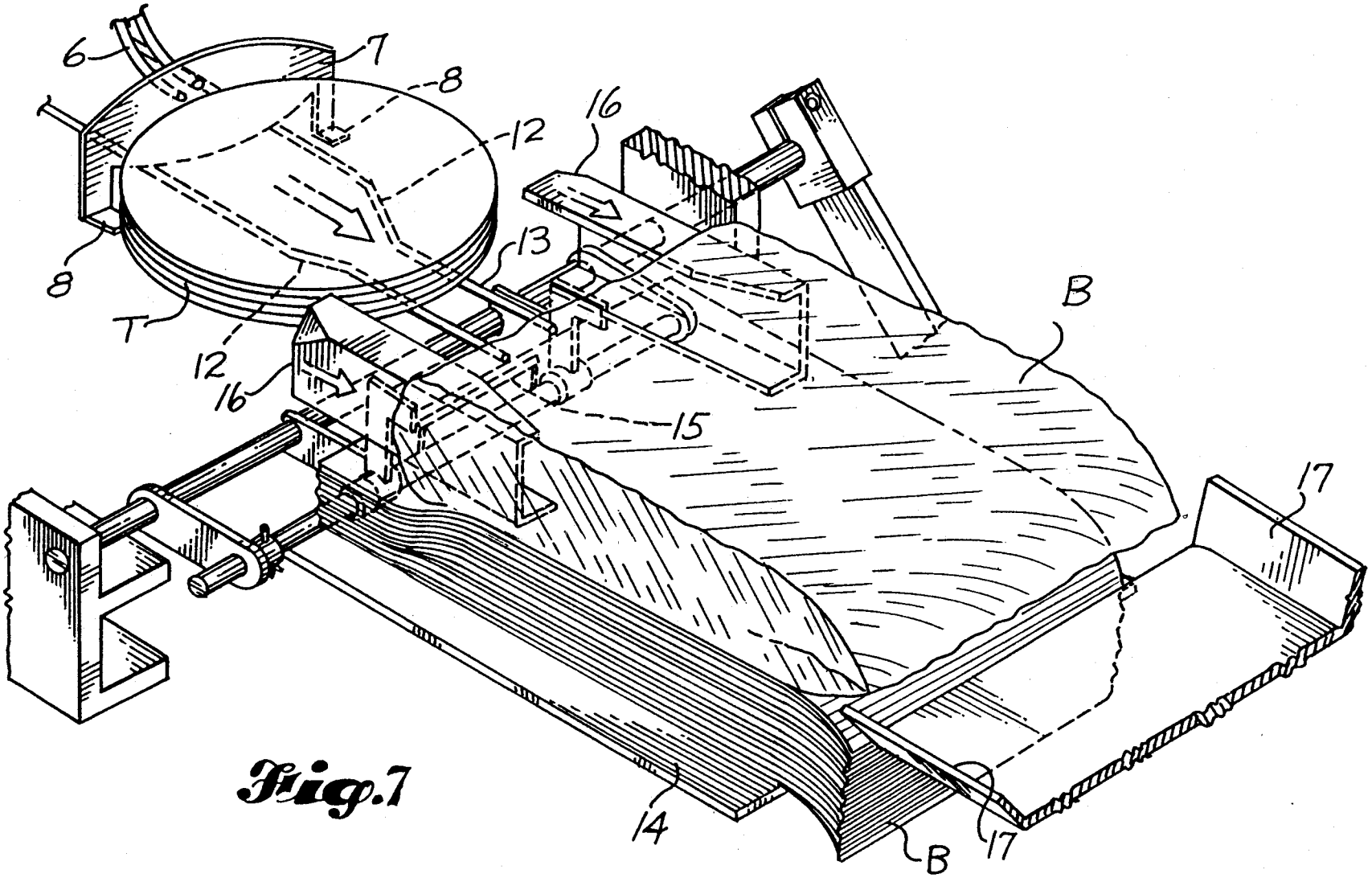

As shown in FIGS. 7, 8, 9 and 10, each pusher 7 has depending from it fingers 8, the lower end portions of which are bent, as shown in FIG. 7, so as to provide shelves underlapping the trailing margins of the tortillas T engaged by the pusher. Such underlapping portions of the depending fingers can be engaged beneath the trailing margin of the tortillas when they are in the arched condition shown in FIGS. 4 and 5 where the opposite side portions droop downward from the raised central portion because of the gap formed by the blocks 2 raising the central portions of the articles above the slats of the conveyor 1, as shown in FIGS. 4 and 5. The spacing between the fingers 8 of each pusher is greater than the width of the blocks 2 transversely of the conveyor, as shown in FIG. 5, but the spacing of such fingers is less than the diameter of the tortillas so that the shelves formed by the bent tips of the fingers will engage the marginal portion of the tortillas at the end of a minor chord of the tortillas, such as at approximately quarter points of the tortillas.

From the slat conveyor 1, the stack of articles is transferred to a stationary slide, preferably composed of two generally parallel rods extending lengthwise of the direction of movement of the conveyor from the discharge end of the conveyor to the bagging station.

The end portions 9 of the slide rods adjacent to the conveyor 1 are spaced apart a distance equal to the spacing of the grooves 3 in the blocks 2, and such end portions of the slide rods are received in such grooves, as shown in FIGS. 1 and 5. Since such leading ends of the slide rods lie in the grooves 3, they are below the arched central portions of the tortillas T, as shown in FIG. 5.

Because the leading ends of the slide rods overlap the trailing end of the conveyor 1, the tortillas can be transferred from such conveyor to the slide rods and be supported continuously, either by the conveyor or by the slide rods or by the overlapping portions of the conveyor and the slide rods acting cooperatively. Transport of the tortillas along the slide rods 9 by the conveyor 1 will be discontinued as the blocks 2 are withdrawn below the slide rods by their downward movement at the discharge end of the conveyor.

As is evident from FIG. 1, the pushers 7 including the fingers 8 will transfer each stack of tortillas positively from the loading conveyor 1 to the slide rods as the blocks 2 are withdrawn downward from contact with the bottom tortilla of the stack. It is preferred that the pushers 7 actually move somewhat faster than the conveyor 1 so as to push each stack of tortillas positively off a group of grooved blocks 2 of the conveyor and onto the rod slide.

The rod slide preferably is composed of five sections. The entrance section formed by parallel rod portions 9 spaced relatively closely are connected to divergent rod sections 10. A central section has parallel rods 11 spaced apart farther than the rods 9. The trailing ends of rods 11 are connected to converging rod sections 12 shown best in FIG. 7 that in turn are connected to the trailing section rods 13 which are parallel and spaced apart a distance approximately equal to the spacing of the leading end rods 9.

The rods 13 at the trailing end of the slide extend to a position adjacent to the bagging mechanism. A stack of bags B, preferably of polyethylene or similar plastic material, is supported on a plate 4, and form receiving enclosures for the tortilla stacks. The bags in the pack have spaced apertures at their open ends which are threaded onto bales 15. The open ends of the bags are opened by an air jet so that spreader fingers 16 can reciprocate into the end of the bag and spread it open generally in the manner described at column 2, lines 41 to 57, of U.S. Pat. No. 3,527,337. FIG. 7 indicates motion of the spreader fingers 16 into the open end of the bag.

Opening of a bag is effected in timed sequence with movement of a pusher 7 to slide a stack of tortillas along the slide rods into the opened bag, as indicated in FIGS. 7 and 9. During movement of the stack of tortillas along the slide rods 11 the fingers 8 of the pusher 7 will straddle such rods, as shown in FIG. 8 and FIG. 9 and, as the pushers advance sufficiently to slide the stack of tortillas off the trailing ends of the slide rods, the underlapping ends of the depending fingers 8 form shelves to support the trailing margins of the tortilla stack.

Figure 11:
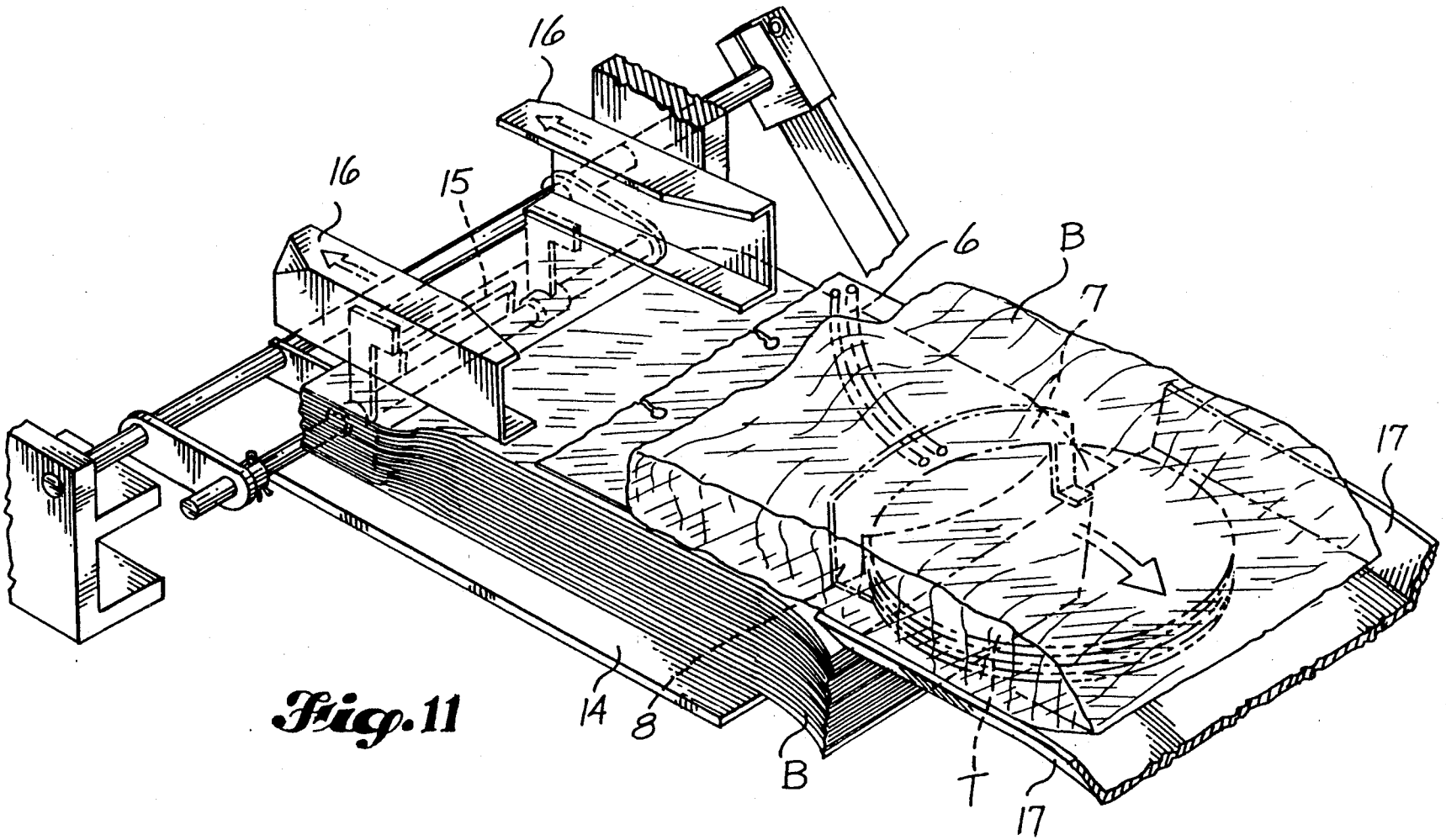
FIG. 11 is an enlarged top perspective of the discharge end portion of the apparatus shown in FIG. 1.

When a pusher 7 has pushed a stack of tortillas into a bag B and off the slide rods 13, continued movement of the pusher against the stack of tortillas in the bag will strip the filled bag from the stack of empty bags, as indicated in FIG. 11, and move the bagged tortilla stack across the stack of bags B and onto a receiving trough 17, as shown in FIGS. 10 and 11. Continued movement of the pusher will push the bagged tortilla stack along the trough until the pusher mounting rod 5 reaches the end of the pusher orbit and begins to rise into the return portion of the orbit. Such motion will effect withdrawal of the pusher and the fingers 8 so that the stack of tortillas will be laid into the bag as the pusher is withdrawn, as shown in FIG. 12. The released bag will then either slide by gravity down trough 17 if it is sufficiently inclined or will be pushed along such trough by engagement of the next filled bag with it which is still being propelled by a pusher.

As a filled bag is stripped from the bag stack, as indicated in FIG. 11, the spreader fingers 16 will be withdrawn preparatory to entering the next bag in the manner shown in FIG. 7 when the next pusher engages the next stack of tortillas and slides it along the slide bars to the bagging station.

I claim:

1. Apparatus for packing a flat limp article comprising conveyor means including supporting means engageable by the central portion of the article for supporting the article in arched configuration with its central portion raised and its opposite edge portions dropping from such central portion, said supporting means having an upwardly opening slot elongated in the direction of movement of the conveyor means, pusher means engageable with an edge of the article for pushing such article off said conveyor means and including a depending portion having a shelf for underlapping the marginal portion of the article at the edge engageable by the pusher means, said conveyor means having a discharge end, and slide means adjacent to and partially overlapping said discharge end of said conveyor means onto which said pusher means can push the article from said conveyor means while being continuously supported during its transfer from said conveyor means to said slide means, and said slide means including a stationary member engageable in said slot beneath the central portion of the article supported by said supporting means.

2. The apparatus defined in claim 1, in which the supporting means includes a block carried by the conveyor means and having two upwardly opening grooves elongated in the direction of movement of the conveyor means, and the slide means includes two elongated members receivable respectively in said grooves of said block.

3. The apparatus defined in claim 2, in which the elongated members of the slide means are stationary slide rods having their lengths extending lengthwise of the direction of movement of the conveyor means.

4. The apparatus defined in claim 3, in which the depending portion of the pusher means includes two depending fingers spaced apart farther than the spacing of the slide rods.

5. The apparatus defined in claim 3, bag supply means, a bag from which constitutes the receiving enclosure, and the slide means extends from the conveyor means to the bag supply means.

6. Apparatus for packaging a flat article comprising conveyor means including supporting means engageable by the central portion of the article and having an upwardly opening slot elongated in the direction of movement of the conveyor means, pusher means engageable with an edge of the article for pushing such article off said conveyor means, said conveyor means having a discharge end, and slide means adjacent to and partially overlapping said discharge end of said conveyor means onto which said pusher means can push the article from said conveyor means, and said slide means including a stationary member engageable in said slot beneath the central portion of the article supported by said supporting means.

7. The apparatus defined in claim 6, in which the supporting means includes a block carried by the conveyor means and having two upwardly opening grooves elongated in the direction of movement of the conveyor means, and the slide means includes two elongated members receivable respectively in said grooves of said block.

8. The apparatus defined in claim 7, in which the elongated members of the slide means are stationary slide rods having their lengths extending lengthwise of the direction of movement of the conveyor means.

9. The apparatus defined in claim 8, in which the depending portion of the pusher means includes two depending fingers spaced apart farther than the spacing of the slide rods.

* * * * *

UNITED STATES PATENT AND TRADEMARK OFFICE

CERTIFICATE OF CORRECTION

PATENT NO. : 5,228,275

DATED : July 20, 1993

INVENTOR(S) : Alvin C. Formo

It is certified that error appears in the above-indentified patent and that said Letters Patent is hereby corrected as shown below:

Column 4, line 13, " packing" should read--packaging--.

Signed and Sealed this

Twenty-sixth Day of April, 1994

Bruce Lehman

*Attest:*

BRUCE LEHMAN

*Attesting Officer*

*Commissioner of Patents and Trademarks*